US012702206B2

(12) United States Patent
Arnold

(10) Patent No.: US 12,702,206 B2
(45) Date of Patent: Aug. 11, 2026

(54) PORTABLE SUSPENDED INVERTED UMBRELLA WITH QUICK RELEASE FABRIC

(71) Applicant: Robert Scott Arnold, San Diego, CA (US)

(72) Inventor: Robert Scott Arnold, San Diego, CA (US)

( * ) Notice: Subject to any disclaimer, the term of this patent is extended or adjusted under 35 U.S.C. 154(b) by 329 days.

(21) Appl. No.: 18/186,349

(22) Filed: Mar. 20, 2023

(65) Prior Publication Data

US 2024/0315410 A1 Sep. 26, 2024

(51) Int. Cl.
*A45B 23/00* (2006.01)
*A45B 11/00* (2006.01)

(52) U.S. Cl.
CPC ..... *A45B 23/00* (2013.01); *A45B 11/00* (2013.01); *A45B 2023/0037* (2013.01)

(58) Field of Classification Search
CPC ..... A45B 2019/008; A45B 2023/0037; A45B 11/00; A45B 23/00; A45B 2023/0081
See application file for complete search history.

(56) References Cited

U.S. PATENT DOCUMENTS 2,767,723 A * 10/1956 Sears, Jr. ..... A45B 23/00 135/21
3,765,434 A * 10/1973 Riggs ..... F16M 13/022 135/20.1
4,061,154 A * 12/1977 Cox ..... A45B 25/18 135/33.5
4,284,095 A * 8/1981 Norton ..... A45B 11/00 135/21
4,449,542 A * 5/1984 McSwain ..... A01M 31/025 135/21
5,429,147 A * 7/1995 Barrington ..... A45B 15/00 135/33.5
5,499,644 A * 3/1996 Geniele ..... A45B 17/00 135/21
5,937,881 A * 8/1999 Villa ..... A45B 23/00 135/21

(Continued)

FOREIGN PATENT DOCUMENTS

GB 2304283 A * 3/1997 ..... A45B 23/00

*Primary Examiner* — Noah Chandler Hawk

(57) ABSTRACT

The present invention relates to a suspended inverted umbrella shade system that provides a lightweight portable sun blocking solution, with fast deployment and removal, safe under high wind conditions. The system allows for freedom of movement under an easily and broadly reconfigurable shaded area. The shade system includes a lightweight adjustable cantilever with only two cam levers for simplified positioning, suspending an inverted umbrella framework with a simple twist release handle and a tight durable storage configuration. A flower petal fabric assembly provides immediate reaction in high wind, safely releasing attached fabric petals at engineered pressure. The invention description provides step-by-step instructions for one-handed operation, including rotation and tilt position adjustment, finishing with the safe removal and storage of the shade. Overall, the suspended inverted umbrella system simplifies shade operation, making it accessible to a broader user base, including disabled individuals.

17 Claims, 6 Drawing Sheets

(56) References Cited

U.S. PATENT DOCUMENTS

| | | | | |
|---|---|---|---|---|
| 6,860,280 | B2 * | 3/2005 | Wolcott | B63B 17/00 135/21 |
| 7,156,114 | B2 * | 1/2007 | Lo | A45B 23/00 135/21 |
| 9,232,836 | B1 * | 1/2016 | Zaccaro | A45B 23/00 |
| 10,212,996 | B2 * | 2/2019 | Stewart-Stand | A45B 23/00 |
| 10,309,580 | B1 * | 6/2019 | Baker | E04H 12/2215 |
| 2016/0262507 | A1 † | 9/2016 | Glatz | |

* cited by examiner
† cited by third party 1B
21
23
24
26
25
28
31
32
43
22
42
44
41
27
34
29
33
30
49

21

35
39
36
37
38

FIG4A
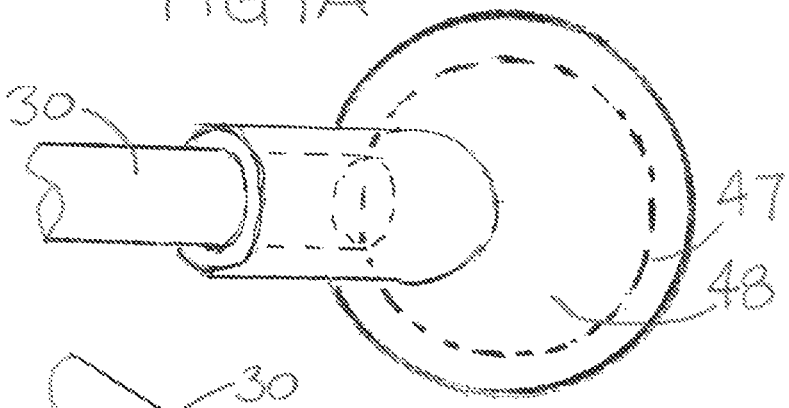
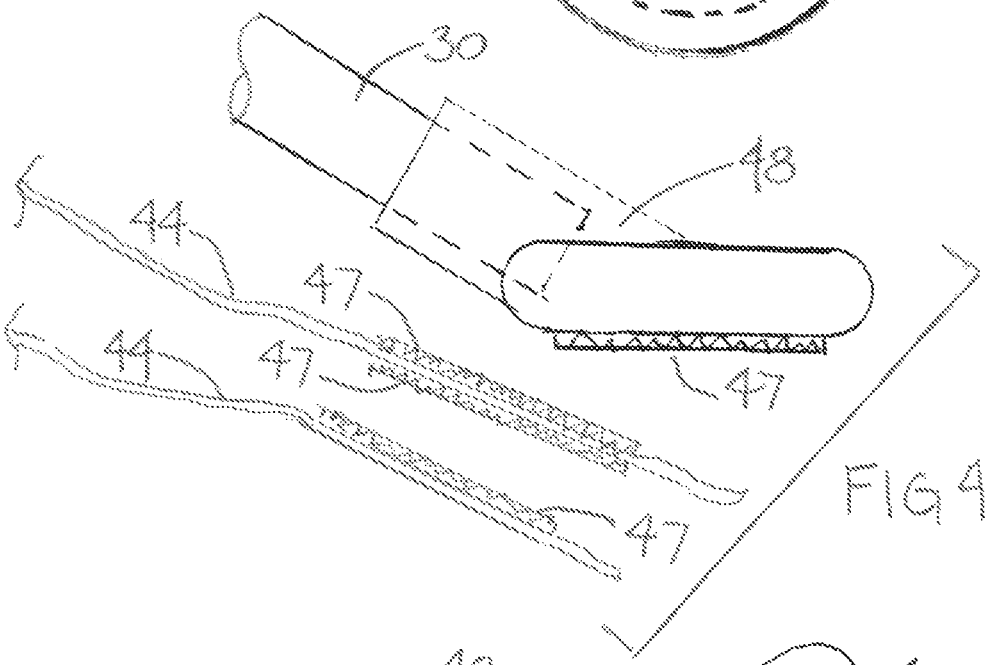
FIG4B
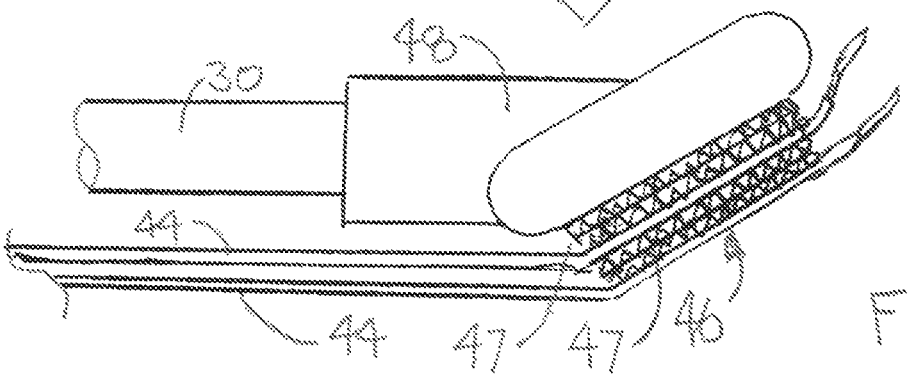
FIG4C

PORTABLE SUSPENDED INVERTED UMBRELLA WITH QUICK RELEASE FABRIC

CROSS-REFERENCE TO RELATED APPLICATIONS

This non-provisional patent application is a Continuation-In-Part application claiming the benefit of priority to commonly-owned U.S. patent application Ser. No. 17/185,280 for PORTABLE SUSPENDED INVERTED UMBRELLA WITH QUICK RELEASE FABRIC, filed on 25 Feb. 2021, currently pending, which is incorporated by reference as if fully set forth herein.

BACKGROUND OF THE INVENTION

In various types of outdoor activities, but specifically with respect to boating, it is desirable to employ one or more methods of alleviating the effects of direct sunlight on the participants or passengers. Shade solutions, as are currently known in the art, are offered for boating, recreational vehicles, outdoor patios and other active areas. These shade systems are often permanently attached, heavy, mechanically complicated and difficult to position.

In the context of shade solutions for fishing boats, for example, it is desirable for such shade solution to provide freedom of movement under the shade and around the full perimeter of the vessel. Some attempted solutions in the art employ the use of the vessel's T-top rod holders for a cantilever square frame shade provided at boat rear cockpit; however this depicts a solution that is more cumbersome to deploy and recover, and potentially unsafe to occupants if left deployed in harsh wind weather conditions. Other solutions known in the art mount to the side of the boat with a cantilever suspended umbrella, however, this configuration restricts fishing access and requires significant clearance space below to open and close the bottom opening umbrella. Yet other shade systems mount to the boat hull sides, but this makes it difficult for fishing line to transition around the boat and is also cumbersome to deploy and recover for movement, wind and weather.

There exists, therefore, a need in the art for an improved apparatus, system, and related method of use for the safe and convenient operation of shade systems for use in outdoor activities, and specifically, for boating applications, that overcomes the shortcomings of the current state of the art.

SUMMARY OF THE INVENTION

Commonly-owned U.S. patent application Ser. No. 17/185,280 for PORTABLE SUSPENDED INVERTED UMBRELLA WITH QUICK RELEASE FABRIC, addresses the shortcoming in the current state of the art with novel and inventive claims directed to a suspended inverted umbrella shade system having an inverted umbrella held at the end of a holder at an adjustable angular and axial position, the umbrella having ribs and stretcher connections with wedge-angled surface hinges that interlock in a keystone ring when the umbrella is collapsed, or the use of a slotted tip base tube used to anchor the holder into an extant fishing rod holder. The invention described and disclosed herein presents improvements to the invention disclosed and claimed in U.S. application Ser. No. 17/185,280 (referred to herein as, "the '280 invention").

This improvement of the '280 invention is directed to the shade system operation method and improved fastening features. Simplification of the shade operation makes the apparatus more accessible to a broader base of user sizes and user capabilities, including disabled individuals. Installation of the cantilever system is improved with the disclosure herein of a multifunction cam bolt and lever, using one cam action to release a clamping force on the structurally connected tubes and further, releasing the teeth engagement of the toothed mechanical coupling such as, but not limited to, those known in the art as "Hirth" or "Curvic" couplings, (this type of toothed mechanical coupling is, for simplicity of disclosure, referred hereinafter simply as a "toothed mechanical coupling") used to hold the cantilever and shade in position. Multiple instances of the toothed mechanical coupling/tube fastener systems can be used to position one or more of the tube's linear position in the clamp as well as the tube's rotation angle, thereby enabling a user to position the shade into virtually any position—limited mainly by the length of the tubes and number of toothed mechanical couplings—with minimal effort.

When in the stored (folded or collapsed) state, the rigidity of the umbrella framework is enhanced via interlocking edge tabs of the keystone hinges. Whereas the original simplified keystone hinge surfaces did not lock and individual hinges were able to slide in and out of the formed circumference ring, locking the keystone surfaces firmly together in the closed position improves the rigidity and strength of the ring, thereby increasing protection of the stored framework against unintended crushing force.

Deployment of the umbrella framework is simplified by adapting a circumference notched center shaft feature with a conical tip, allowing the lower hub of the inverted framework to be easily inserted into the open shade and locked position, and then with a rotation of the handle, remove the hub from the center tube attachment and lower the hub, closing the shade framework. In embodiments, this feature can be actuated even when out of reach overhead, by using a mated engagement tool with a comfortable length handle.

Improved safety of the system is provided with a flower petal radial separation of fabric segments, aligning with umbrella ribs in this embodiment. Circumference edges of the segments are attached to releasable tips, configured to release either upward or downward, to react to gusts of wind in any direction. In this embodiment, an engineered reclosable fastener system is designed to a measured shear and tensile connection strength that is stronger than its peel or cleavage connection strength (a non-limiting example of this type of fastener system is 3M Dual Lock). Orienting this fastener between the fabric and the rib tip, at a specific angle relative to the rib/fabric plane, creates a predictable release behavior that ensures fabric pressure and stress will never exceed the capacity of the framework and cantilever. In this embodiment, released fabric, otherwise attached durably at the hub, will release from the shade position to a loose fluttering position, removing wind induced pressure on individual panels and relieving excess force applied to the framework.

An object of the present invention is to provide a strong, lightweight and compact umbrella framework.

Another object of the present invention is to provide optimized, high pressure cam lever fastening for the toothed mechanical coupling and clamped tube system.

Yet another object of the present invention is to provide simple cantilever deployment and positioning with only two control points.

A further object of the present invention is to provide an inverted umbrella apparatus configured to allow for one-handed shade installation and opening, and then closing and storage.

Another object of the present invention is to provide an inverted umbrella apparatus having a "gas cap" style handle for easy push-to-lock and turn-to-unlock action.

A primary object of the invention is to provide an inverted umbrella apparatus that is configured with mechanical features that facilitate the automatic and safe release of fabric panels under wind pressure to prevent damage or harm to the apparatus or to persons.

Additionally, a storage holster for rapid storage and retrieval of the inverted umbrella apparatus is disclosed, for when wind is expected.

BRIEF DESCRIPTION OF DRAWINGS

In the accompanying figures, like reference numerals refer to identical or functionally similar elements throughout the separate views. The accompanying figures, together with the detailed description below are incorporated in and form part of the specification and serve to further illustrate various embodiments and to explain various principles and advantages all in accordance with the present invention, in which:

FIG. 4A is a top view of an eye protecting rib tip dimensioned to attach a reclosable fastener (such as 3M™ Dual Lock™)

FIG. 4B is a side view of an eye protecting rib tip angled for predictable wind release with a reclosable fastener, and fasteners attached to two fabric panels positioned for assembly FIG. 4C is a side view of rib tip angled for predictable wind release with reclosable fasteners assembled with two fabric panels

DETAILED DESCRIPTION OF THE INVENTION

We disclose a suspended inverted umbrella shade system which is an improvement over the commonly-owned '280 invention.

Figure 1A:
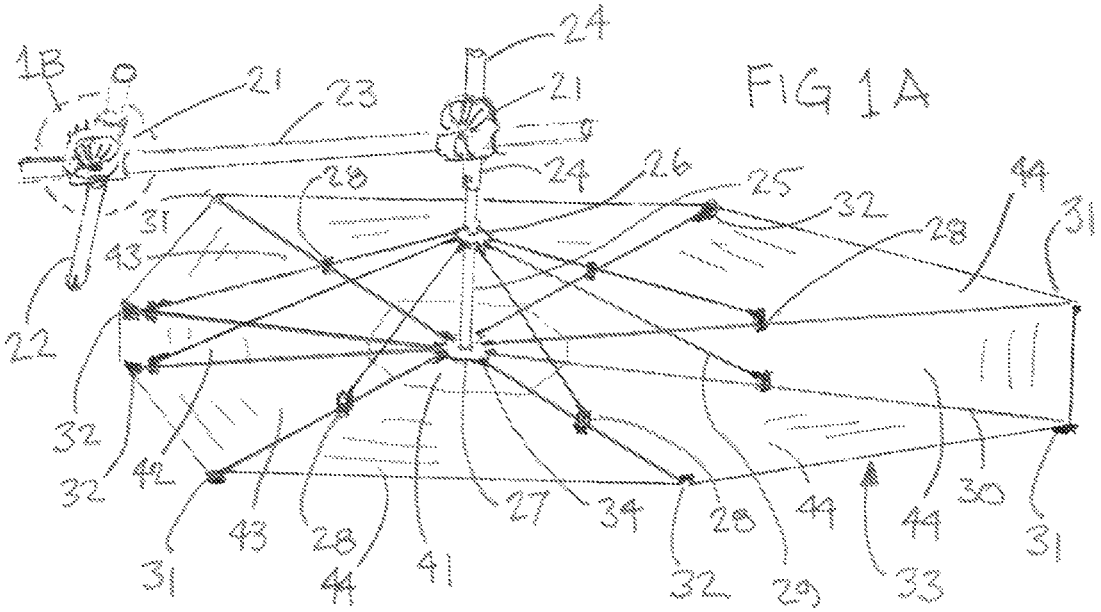
FIG. 1A is a perspective view of the deployed configuration of a short cantilever holder apparatus with two clamp assemblies and an asymmetric shade apparatus showing fabric attached to umbrella framework
Figure 1B:
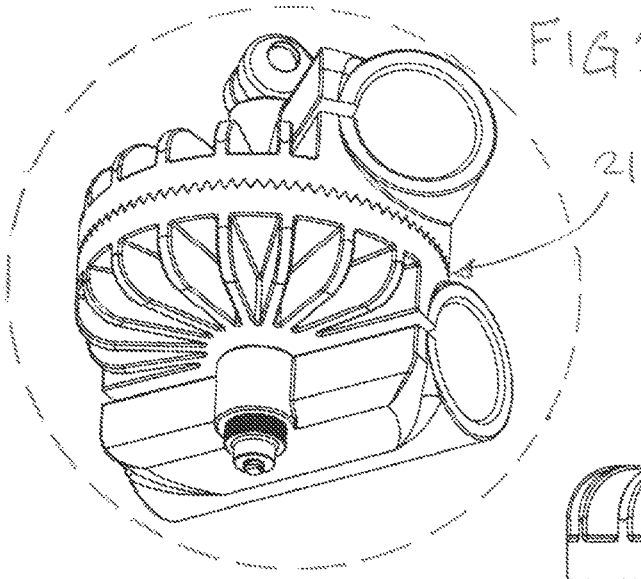
FIG. 1B is a perspective view of the toothed mechanical coupling showing the integrated circumference clamps with cantilever members removed
Figure 1C:
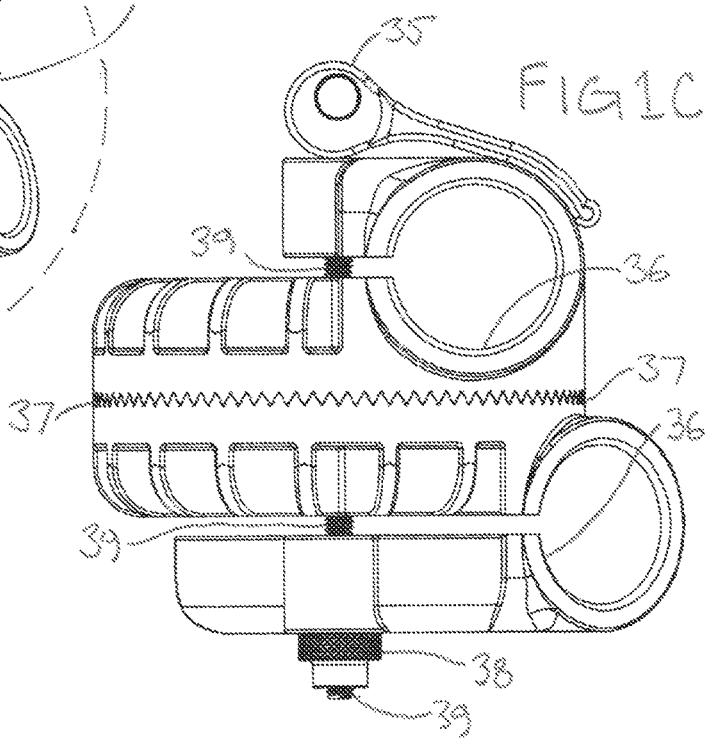
FIG. 1C is a side view of the toothed coupling assembly with the cam clamp in the fully closed and locked position where cantilever members are firmly set in position
Figure 2A:
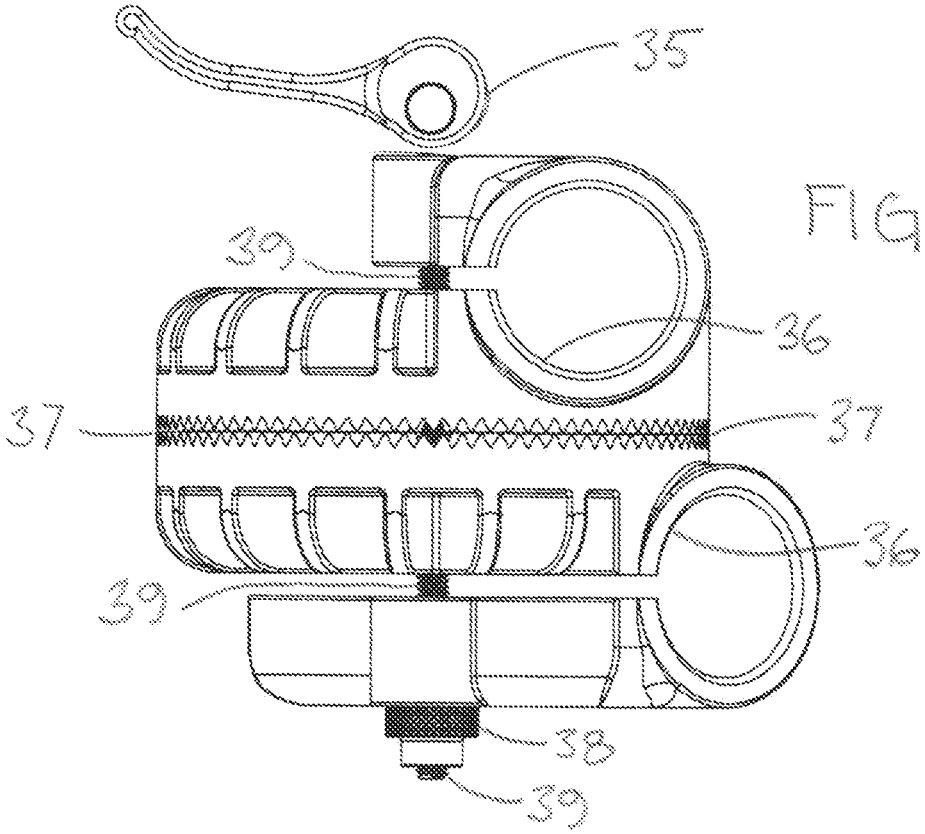
FIG. 2A is a side view of the toothed coupling assembly with the cam clamp in the fully open position where the circumference clamps and the toothed coupling are relaxed and cantilever members are easily repositioned
Figure 2B:
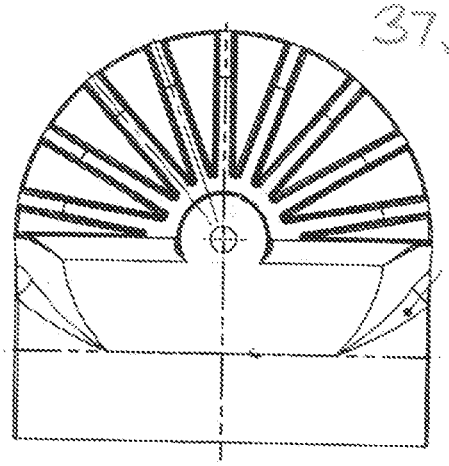
FIG. 2B is a top view of one half of the toothed coupling assembly with the through bolt and cam clamp removed
Figure 2C:
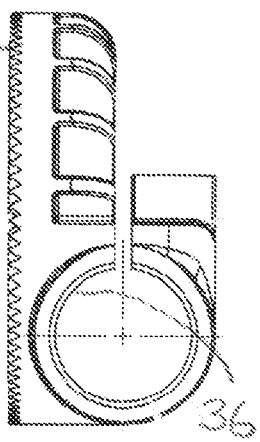
FIG. 2C is a side view of one half of the toothed coupling assembly with the through bolt removed and the circumference clamp presented
Figure 2D:
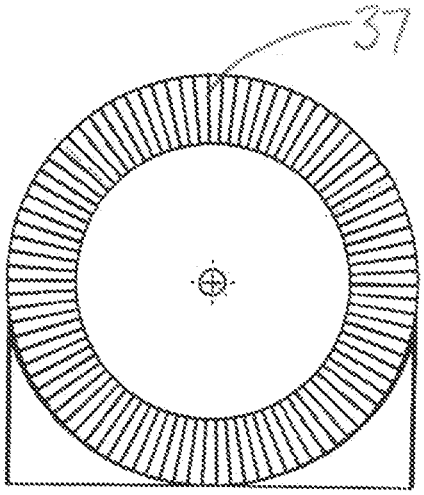
FIG. 2*d* is a bottom view of one half of the toothed coupling assembly with the through bolt removed and 360 degrees of engagement teeth presented

Referring to the figures in general and to FIG. 1A in particular, we disclose an improvement to the '280 invention that includes an axial and angular adjustment system for the umbrella holder (21) to lock the hanger and umbrella shade framework at a desired—and freely adjustable-height, tilt angle and umbrella axis rotation. The component that provides the improved features is the toothed mechanical clamp assembly (21) as shown closed in FIG. 1C and opened in 2A. The toothed mechanical clamp and connected circumference clamps (36) require only one cam (35) movement to fix angular position, linear separation position, and rotational position of attached members. With 2 toothed mechanical clamp assemblies attached by a common member, only 2 points of cam action are necessary for complete shade positioning. A first circular toothed face (37) is directly attached to a circumference clamp (36). A second circular toothed face is configured to mate with the first circular toothed face (37) and is also attached to its own circumference clamp (36). Each toothed face is complementary such that, when mated the teeth interface—nest—with each other. (See detail of FIG. 2D.) The two circular toothed faces are also aligned coaxially with each other. A clamp shaft (39) is coaxially aligned with the two toothed faces and insertably mated thereto. The components are arranged such that, while maintaining coaxial alignment, the two toothed faces are able to rotate relative to each other when the clamp shaft cam (35) or hand turn nut (38) are not engaged (unlocked). When the clamp shaft cam lever (35) or hand turn nut (38) are fully engaged (locked) the two toothed faces are pressed together and the circumference clamps are compressed around structural supporting elements, including a rod holder insert (22), a cantilever (23), and a bayonet shade hanger (24) as shown in this embodiment. The toothed arrangement will force the two toothed faces to interlock, thereby resisting any movement of the faces relative to each other. The cam lever (35) or hand turn nut (38) also have a stable position in between the locked and unlocked positions, providing engagement of the two toothed faces (37) for position stability while allowing the circumference clamps (36) to relax pressure on surrounded structural elements for rotation and linear adjustment.

Figure 3A:
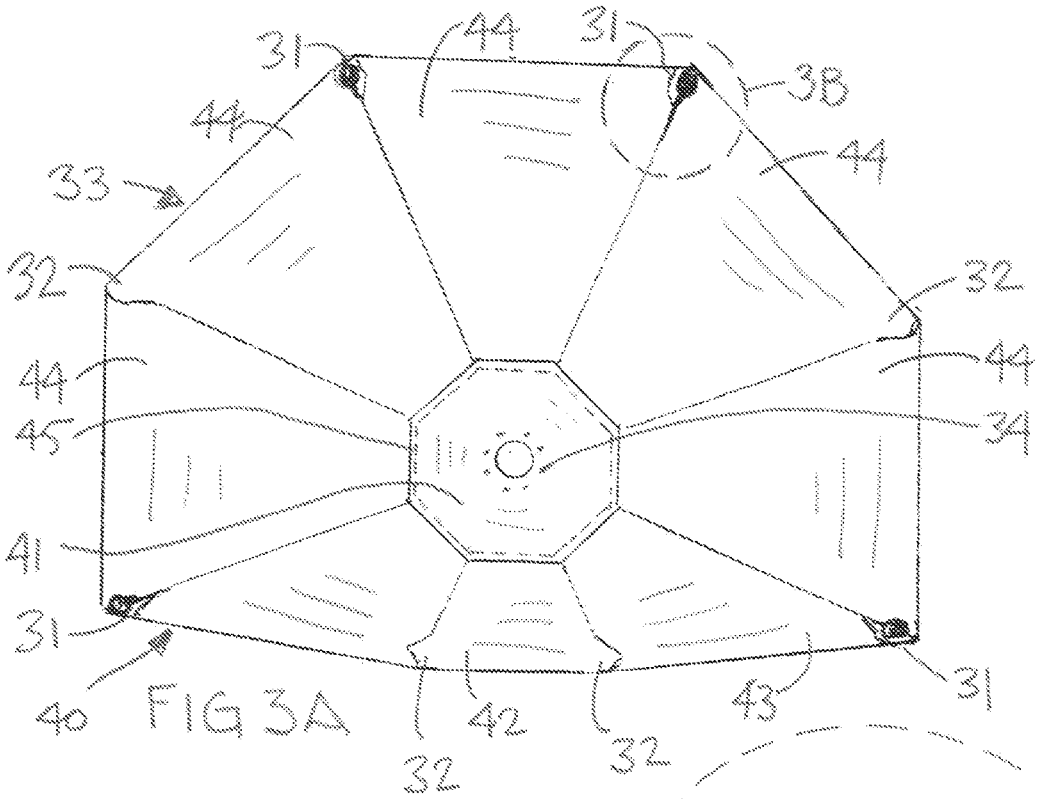
FIG. 3A is a bottom view of the asymmetric "flower petal" shade fabric assembly with attachments at center octagonal panel and 4 petal tips configured to release upward and the other 4 petal tips releasing downward.
Figure 3C:
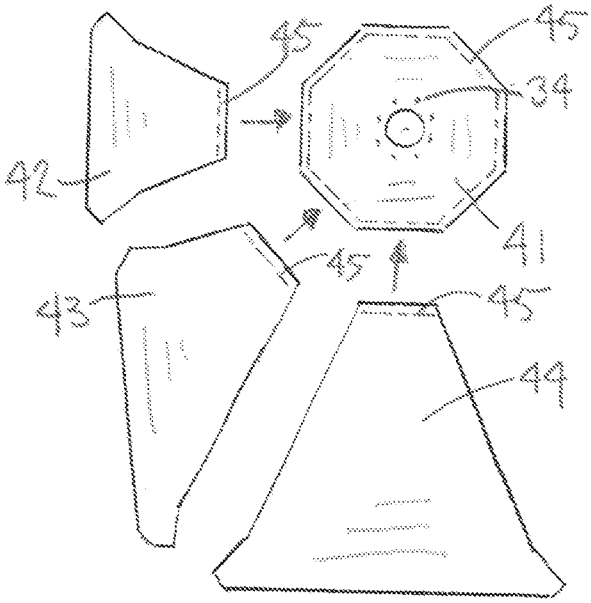
FIG. 3C is a fabric parts view of the asymmetric "flower petal" shade panels center octagonal panel
Figure 3B:
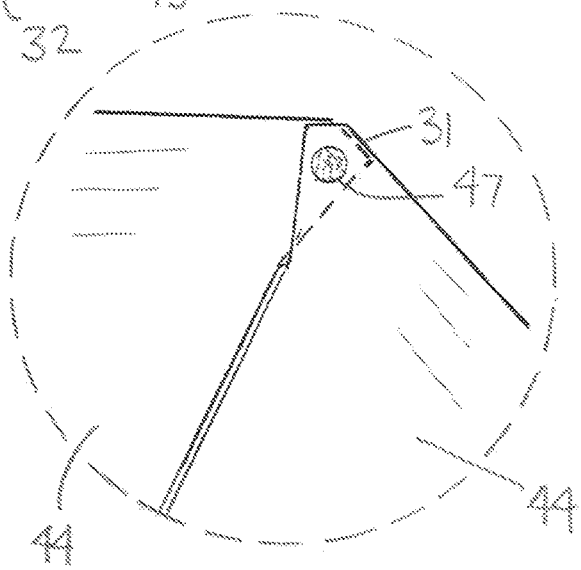
FIG. 3B is a bottom view of one rib tip attachment point of two adjacent panels where fabric overlaps at the reclosable fastener mounting surface

Referring now to FIG. 3A, an improved safety release fabric configuration is designed to release at preset wind speed. In embodiments, an umbrella framework hub supports attached fabric assembly (40) with "flower petal" panels (33) attached at one edge (45) surrounding a fabric center panel (41) attached at ribs (34) (see FIG. 3C). Each flower petal panel has 2 tip releases (31) (32) where the panel is attached to the umbrella frame tips with an angled surface attachment, using the specified attachment angle to promote easy fabric release at a predetermined wind speed. In this embodiment, panels are long (44), or short (42), or asymmetric (43) where alternating "up (31) or down (32)" release configurations are possible where the fabric panels react to wind pressure for all wind conditions in all directions as experienced in outdoor weather. For safety, an angled release tip (48) (see FIGS. 4A and 4B) positioned "up" (31) on one corner of a fabric panel can be positioned "down" (32) (180 degrees rotation) on the opposite corner of the same panel (46), allowing high pressure to force panel release in either wind direction. Reclosable fastener systems (47) (such as 3M™ Dual Lock™) that measure high in tensile and shear strength, but lower in peel and cleavage strength, can be interconnected in fabric layers at each releasable tip (46) (see FIGS. 4B and 4C).

Figure 5A:
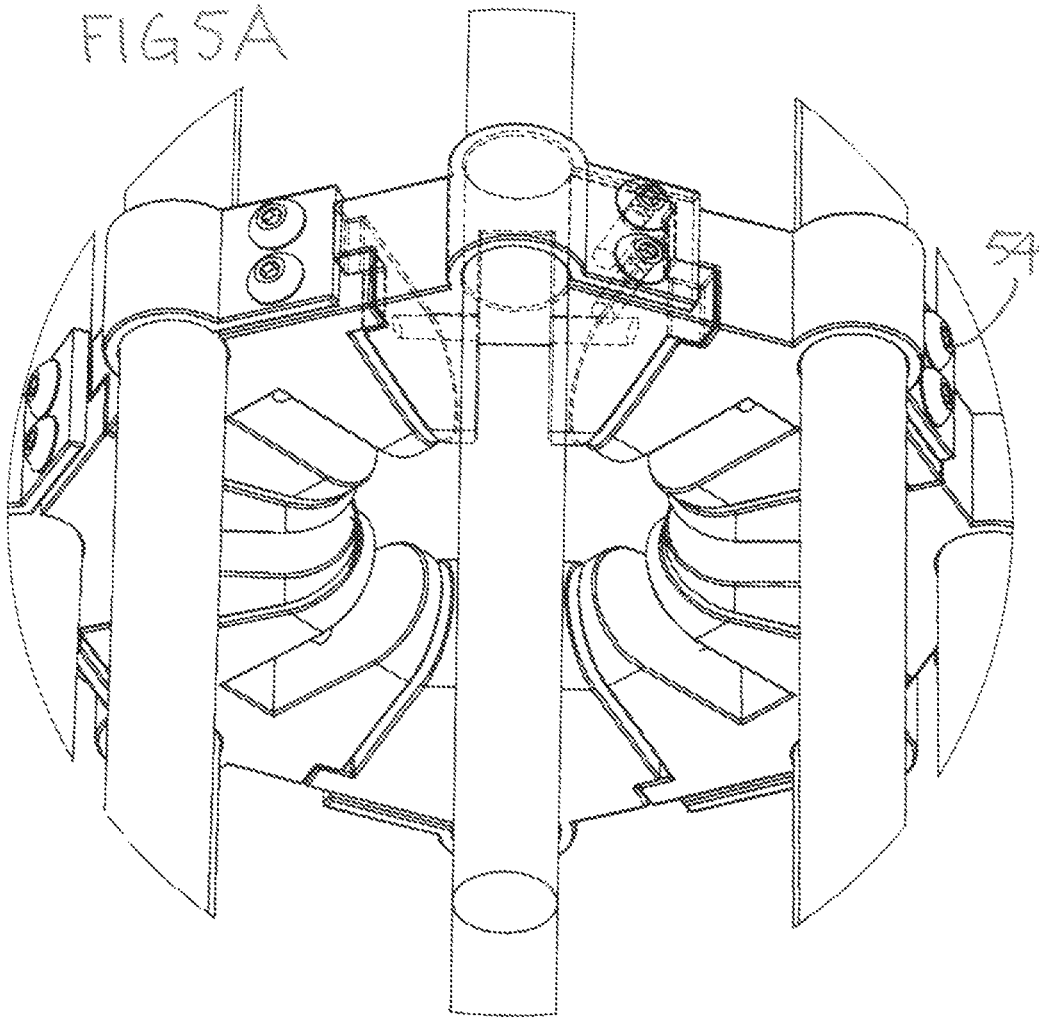
FIG. 5A is a perspective view of closed umbrella ribs and keystone hinges interlocked in a structural ring
Figure 5B:
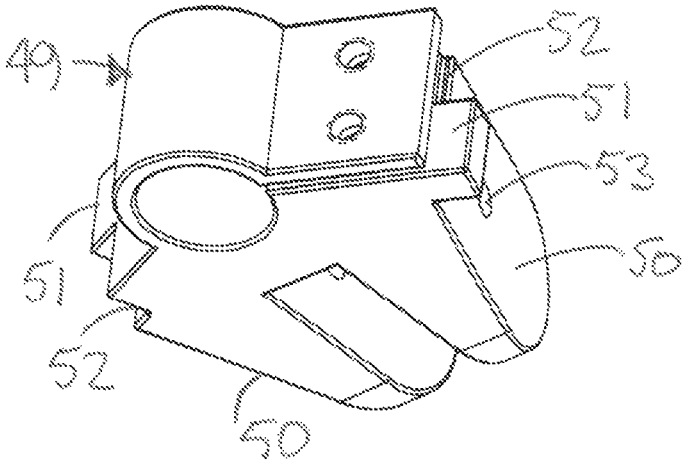
FIG. 5B is a perspective view of a keystone hinge with circumference clamp and interlocking tabs and notches

In other embodiments, as shown in FIGS. 5A and 5B, the umbrella apparatus employs a novel interlocking keystone hinge (28) feature where the closed umbrella frame benefits from the keystone ring surfaces (50) and unidirectional interlocking tabs (51) and notches (52) (see FIGS. 5*c* and 5*d*) which limit mated surface movements of the closed keystone ring. In the unintended event of excessive crushing force applied to a stored umbrella assembly, the interlocking hinges (49) provide structural reinforcement for rib spans (30) to limit damage to the assembly, held in position by stretcher member (29) and pin at stretcher tip (53) and clamp at rib circumference (54).

Figure 6A:
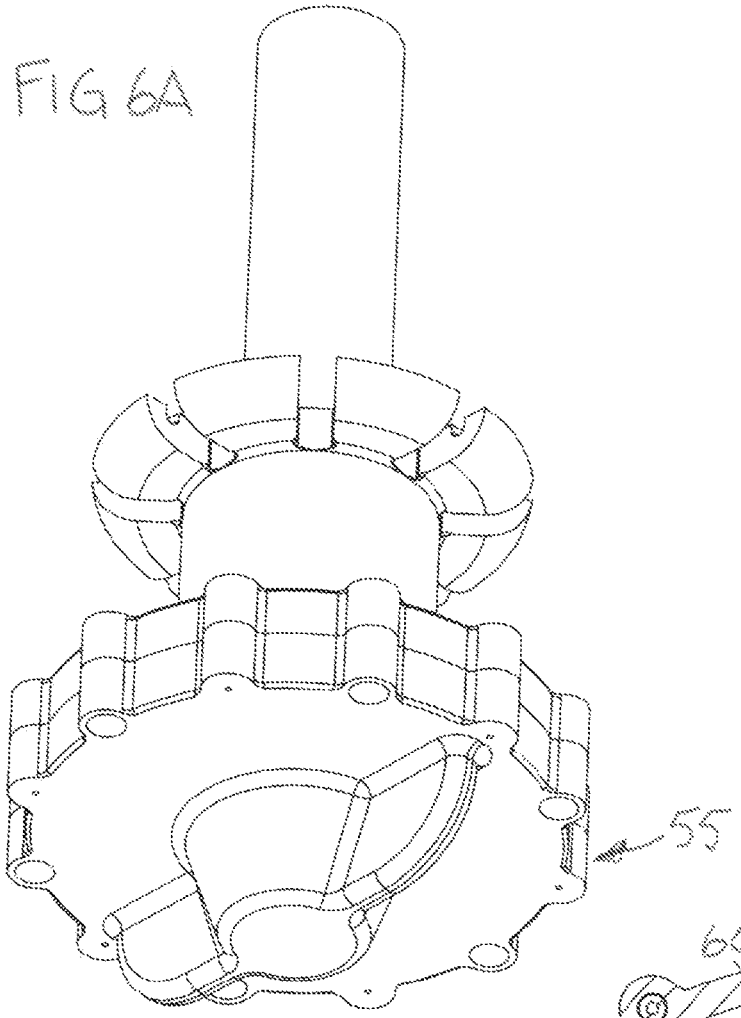
FIG. 6A is a perspective view of the gas cap umbrella handle as viewed from below when the shade is opened overhead
Figure 6B:
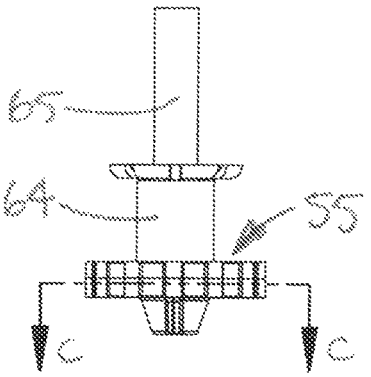
FIG. 6B is a side view of the gas cap handle, the lower hub and the umbrella center shaft
Figure 6C:
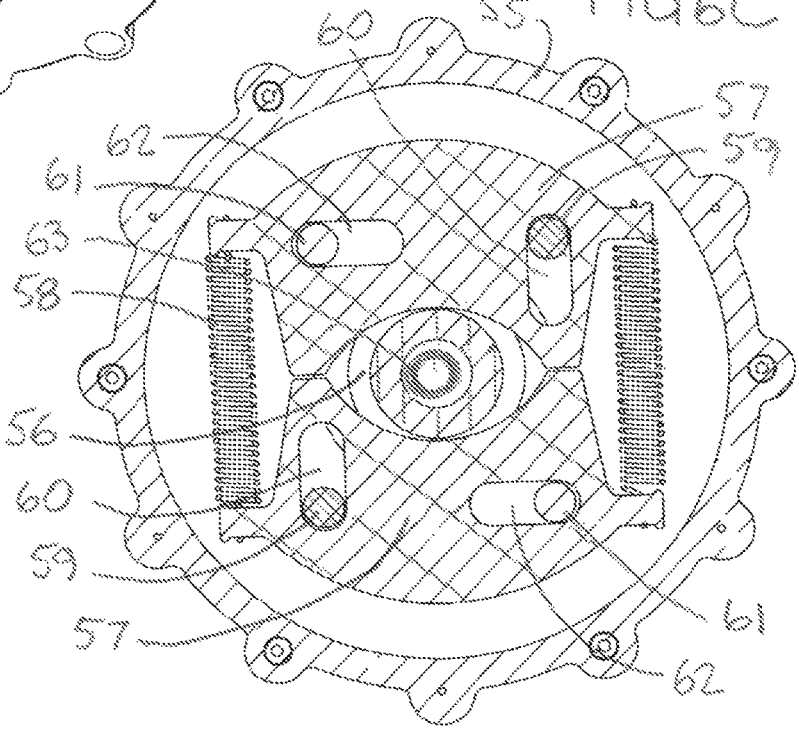
FIG. 6C is a cross section of the gas cap internal locking plates, holding pins and retaining springs While the invention as claimed can be modified into alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the scope of the present invention.

In further embodiments, as shown in FIG. 6A, the umbrella apparatus further includes a gas cap umbrella handle (55) where the push action and force required to lock in the open position can be accomplished without clasping the handle and the release action and force required to close the umbrella is a minor rotation and drop of the handle, which can also be accomplished with a mating shaped pole extension when the handle is out of reach. The handle side view in FIG. 6B shows the position of handle cross section view in FIG. 6C, wherein the lower umbrella hub (64) and center shaft (25) upper stretcher hub (26) positioned overhead in the cantilever (23) hanger (24), is the locking member for the raised lower rib hub (27) and gas cap handle. During insertion, a conical tip of the center shaft forces open sprung (58) catch members to allow the handle to surround the conical tip and to lock the sprung members (57) inside a catch notch (56) holding the umbrella frame firmly in place. The action of raising the lower hub handle into place also pushes an internal pushrod (63) through the length of the center shaft (65), extending out the top of the center shaft to prevent vertical movement of the center shaft bayonet pin and locking the center shaft (65) firmly inside the bayonet socket (24), preventing wind gusts lifting and turning the umbrella shade system, allowing the shade to fall from the hanger. This embodiment displays the catch member action base pin (59) inside the base pin slot (60) which opens catch members during the catch cone insertion; and the catch handle pin (61) and handle pin slot (62) which opens catch members during the handle rotation for release.

One-Handed Operation Steps:

1. Before mounting the cantilever, estimate the desired position for shade with the rod tube to the long cantilever arm to the bayonet socket (positioning 3 members connected by 2 toothed mechanical clamps) and set the 2 linking cam locks to hold firmly.
2. Lift and insert the cantilever into the overhead rod holder, placing the cantilever rod slot over the positioning pin at the bottom of the rod holder. The cantilever can be safely fastened and stored in this position.
3. When shade is desired, lift and insert the umbrella shade into the overhead bayonet socket, turning the shade to engage the socket.
4. Gently lift the bottom center of the umbrella to unfurl the ribs and fabric overhead, continuing until the handle clips and locks into place.
5. Adjust the shade position as necessary using cam clamps. The most frequent adjustments, in the horizontal sweep of the cantilever and the rotated angle of the shade, are performed with one cam lever partially unlocked to allow rotational members movement while keeping the toothed mechanical clamp engaged, the system then held firmly in position by fully locking the cam lever.
6. To remove and store the umbrella shade, turn the center handle to open the handle clips and drop the umbrella center in place, held by the bayonet socket.
7. Lift and rotate the umbrella framework to free it from the bayonet socket and cantilever.
8. In the event of fabric release due to high wind, reset the reclosable fasteners between the fabric panel corners and the umbrella rib tips.
9. Slide the closed umbrella shade into storage or holster, to protect the shade during winds or rapid travel.

It is to be understood that the steps listed above are not intended to be limiting and that the invention may be practiced using other steps that are not explicitly described herein. The present invention provides a portable and efficient way to provide shade with a fast deployment and a safe fabric release under high wind conditions, while also being accessible to a broader base of user sizes and users capabilities, including disabled individuals.

In light of the foregoing description, it should be recognized that embodiments in accordance with the present invention can be realized in numerous configurations contemplated to be within the scope and spirit of the claims. Additionally, the description above is intended by way of example only and is not intended to limit the present invention in any way, except as set forth in the claims. Modifications and changes to the invention should be readily apparent to those having ordinary skill in the art, which modifications are intended to be within the spirit and scope of the invention as claimed. It is also understood that the foregoing description is illustrative of the present invention and should not be considered as limiting. Components from one embodiment can be combined with another embodiment and remain within the spirit and scope of the invention. Therefore, other embodiments of the present invention are possible without departing from the spirit and scope of the present invention.

APPENDIX

Reference Numbers

21 toothed mechanical coupling and circumference clamps assembly

22 slotted fishing rod holder insert member
23 cantilever member
24 bayonet socket member
25 umbrella frame center shat Ft
26 upper shaft attached hub and stretcher tips assembly
27 lower gas cap handle attached hub and rib tips assembly
28 interlocking keystone hinge
29 stretcher member
30 rib member
31 angled release tip for upward peel
32 angled release tip for downward peel
33 fabric assembly with flower petal release panels
34 fabric assembly center frame attachment points
35 cam lever
36 circumference clamp
37 toothed mechanical coupling face
38 hand-turn nut
39 through bolt
40 asymmetric fabric assembly
41 fabric center panel
42 fabric short petal panel
43 fabric asymmetric petal panel
44 fabric long petal panel
45 fabric attachment seam
46 fabric overlap reclosable fastener position
47 reclosable fasteners
48 angled safety release rib tip
49 interlocking keystone hinge
50 keystone mating surface
51 interlocking tab
52 interlocking notch
53 stretcher tip mounting pin hole
54 rib circumference clamp screw
55 gas cap umbrella handle
56 conical catch notch
57 catch member
58 catch member spring
58 handle base catch member pin
60 handle base pin slot
61 handle cap catch member pin
62 handle cap pin slot
63 pushrod
64 lower umbrella ribs hub
65 umbrella center shaft

The invention claimed is:

1. A suspended inverted umbrella shade system comprising:

a shade apparatus comprising:
a hanger,
an umbrella shade framework, and
a safety fabric;

an umbrella holder apparatus thereby suspending said shade apparatus with a quickly-connectable quickly-releasable umbrella hanger socket at a proximal position of the umbrella shade framework;

an axial and angular adjustment system for said umbrella holder to lock said hanger and umbrella shade framework at a desired height, tilt angle and umbrella axis rotation comprising toothed mechanical clamps with 2 points of cam action for complete shade positioning where each cam locks a first circular toothed face directly attached to a circumference clamp, with a coaxial complementary second identical circular toothed face clamp arrangement on the opposite side, using said coaxial enter point as the co-linear clamp shaft of the integrated circumference clamps, the umbrella shade framework being an inverted opening umbrella framework for the said suspended shade apparatus, wherein the framework is fully deployed by lifting a lower umbrella framework hub until it is fastened to a bottom of an umbrella short center shaft, causing an attached plurality of ribs of said framework to angulate and move rib tips thereof outward in connection to a corresponding plurality of umbrella frame stretchers attached at proximal ends to an upper hub and at distal ends to rib hinges, wherein said plurality of umbrella framework ribs and stretchers are each connected with wedge angle surfaced hinges, wherein the closed framework requires all center oriented hinge surfaces to interlock as in a firm keystone ring;

a short center shaft and lower hub quick-connection quick-release locking system for said framework fixing said shade framework into full up and open position; and a fabric release system wherein said safety fabric reacts to high wind forces urging detachment of the fabric at a plurality of rib tips thereby substantially releasing said safety fabric pressure to allow the fabric to fluttering while firmly attached surrounding said umbrella hub, wherein the rib tips are dimensioned to safely avoid a poking hazard.

2. A method of operating the suspended inverted umbrella shade system of claim 1, wherein the method comprises:

a) estimating a desired position for the shade apparatus by setting the toothed mechanical clamps between a rod holder insert, a cantilever, and a bayonet shade hanger;
b) lifting and inserting the rod holder insert into an overhead rod holder, placing a rod slot over a holder bottom positioning pin;
c) lifting and inserting the shade apparatus into an overhead bayonet socket, turning the shade to engage a socket;
d) lifting the bottom center of the umbrella shade framework to unfurl ribs and fabric overhead, continuing until a handle clips and locks into place;
e) adjusting the shade apparatus position as necessary using the toothed mechanical clamps;
f) turning a center handle to a pre-set position to open handle lock clips and drop the umbrella center in place, held by the bayonet shade hanger;
g) lifting and rotating counterclockwise the shade apparatus to free it from the bayonet socket and cantilever;
h) reclosing the releasable tips of a safety fabric to restore shade function, in the event fabric has released under high wind pressure;
l) sliding the shade apparatus into storage or holster to protect the shade during winds or rapid travel.

3. A suspended inverted umbrella shade system as in claim 1, further comprising a bayonet connection with a slotted lock system using one or more placement slots in the umbrella hanger socket and pins in the hanger at the insertion of said umbrella wherein suspended shade position is firmly set.

4. A suspended inverted umbrella shade system as in claim 1, wherein said fabric release system comprises mated interlocking reclosable fastener system configured to have a shear and tensile connection strength that is stronger than its peel and cleavage connection strength thereby allowing fabric surface connection release at substantial wind pressure.

5. A suspended inverted umbrella shade system as in claim 1, wherein said fabric release system comprises a mated interlocking hook and loop surfaces system allowing fabric surface connection release at substantial wind pressure.

6. A suspended inverted umbrella shade system as in claim 1, wherein said fabric release system comprises a spring loaded pinch connection to fabric mechanism allowing fabric release at substantial wind pressure.

7. A suspended inverted umbrella shade system as in claim 1, wherein said fabric release system comprises a breakable material tie to fabric connection, allowing said tie to break thereby releasing fabric at substantial wind pressure.

8. A suspended inverted umbrella shade system as in claim 1, wherein said fabric release system comprises a snap fastener including a rib tip snap connection to fabric button mechanism, allowing fabric snap button release at substantial wind pressure.

9. A suspended inverted umbrella shade system as in claim 1, wherein said fabric release system comprises a magnetic fastener including a magnetic rib tip connection to fabric attachment mechanism, allowing fabric magnetic clasp release at substantial wind pressure.

10. A suspended inverted umbrella shade system as in claim 1, wherein the quick-connection quick-release locking mechanism comprises an internal locking assembly using movable spring-attached clamp members to firmly lock around a center notch, releasable with a rotation or movement that opens the clamps to lower the handle.

11. A suspended inverted umbrella shade system as in claim 1, wherein the short center shaft comprises an internal slidable rod that is urged upwardly as the lower hub is locked into the open position to prevent the suspended framework from being lifted, rotated, or removed when the umbrella framework is opened.

12. A suspended inverted umbrella shade system as in claim 1, wherein the wedge angle surface hinges have complimentary features on each mating surface to tightly interlock and prevent sliding movement under compression.

13. A suspended inverted umbrella shade system comprising:

a shade apparatus comprising a hanger, a suspended inverted umbrella framework having a plurality of panels, and a safety fabric with release, where each panel of the umbrella framework is attached to the umbrella frame tips with an angled surface attachment, using the specified angle and reclosable fasteners to promote easy release at a predetermined wind speed;

a holder apparatus for removably suspending the shade apparatus, wherein a mounted overhead cantilever assembly works as a means to suspend said shade assembly in optimal position horizontally, vertically and rotationally to block the sun, the holder apparatus comprising:

a hanger socket;

a mounting system for secure fixed attachment of said cantilever assembly to a boat tower or boat top or boat enclosure or sailboat boom or sailboat mast structure, wherein the mounting system comprises a slotted tip base tube insertable into an existing fishing rod holder socket as a means to fix said cantilever assembly at the proper height and rotation;

a cantilever adjustment system comprising a plurality of pivotally adjustable indicium connections to support said hanger socket and provide up to 360 degrees horizontal and vertical positioning of said shade apparatus around the holder apparatus to fix said shade apparatus in a vertical or tilted position for optimal shade; and a plurality of tube members within said cantilever assembly attached to said connections as a slidable means for additional length and rotation added to the linear separation between said mounting system and said hanger socket at the opposite end.

14. A suspended inverted umbrella shade system as in claim 13, wherein a clamp is installed around an existing structural member of a boat tower, sailboat boom or vehicle roll cage as a means to connect said cantilever assembly.

15. A suspended inverted umbrella shade system as in claim 13, using a flat base connector with a through bolt hole to connect said cantilever assembly to a vertical or horizontal flat surface.

16. A suspended inverted umbrella shade system as in claim 13, wherein a plurality of adjustable cam lever clamp bolts urge fixed positioning at all adjustable movement points, axially within the rod holder, angularly above the rod holder, linearly and axially with the tube members, angularly above the umbrella assembly hanger, and axially within said hanger as a means to firmly position said umbrella shade system.

17. A suspended inverted umbrella shade system as in claim 13, wherein a plurality of adjustable cam lever clamp bolts urge fixed positioning at all angular, linear and axial connections as a means to firmly position said umbrella shade system.

* * * * *